US006341377B1

(12) United States Patent
Faries, Jr. et al.

(10) Patent No.: US 6,341,377 B1
(45) Date of Patent: Jan. 29, 2002

(54) PERSPIRATION SHIELD EMPLOYING GEL MATERIAL

(75) Inventors: Durward I. Faries, Jr., McLean, VA (US); Robert A. Bishop, II, Plano, TX (US)

(73) Assignee: Medical Products, Inc., Chantilly, VA (US)

( * ) Notice: Subject to any disclaimer, the term of this patent is extended or adjusted under 35 U.S.C. 154(b) by 0 days.

(21) Appl. No.: 09/635,632

(22) Filed: Aug. 10, 2000

(Under 37 CFR 1.47)

Related U.S. Application Data

(60) Provisional application No. 60/148,272, filed on Aug. 11, 1999.

(51) Int. Cl.[7] ..... A41D 27/12

(52) U.S. Cl. ..... 2/53; 420/1; 420/57

(58) Field of Search ..... 450/1, 57, 56, 450/53, 86, 60, 61, 67, 80, 81, 38; 2/73, 267, 268, 53, 56, 57, 1, 453, 463, 46, 50, 60; 604/289, 290, 358, 363, 364, 365, 367, 368, 370–375, 386, 387; 602/41–46, 48, 52, 54, 56

(56) References Cited

U.S. PATENT DOCUMENTS

| | | | | |
|---|---|---|---|---|
| 3,669,103 A | * | 6/1972 | Harper et al. | 604/378 |
| 3,934,593 A | | 1/1976 | Mellinger | |
| 4,074,721 A | | 2/1978 | Smits et al. | |
| 4,992,074 A | | 2/1991 | Diaz | |
| 5,017,174 A | | 5/1991 | Gowrylow | |
| 5,103,500 A | | 4/1992 | Nager et al. | |
| 5,149,336 A | | 9/1992 | Clarke et al. | |
| 5,217,782 A | | 6/1993 | Moretz et al. | |

(List continued on next page.)

OTHER PUBLICATIONS

DermaSof, Plastic Surgical Nursing, vol. 17, No. 4, Winter 1997.

Canderm Pharma Inc., Wound Care, Epi–Derm, printout of Aug. 13, 1998.

Spectragel, The Sheetless Keloid Scar Gel, For the Maintenance of Keloid & Hypertrophic Scars, printout of Aug. 13, 1998.

Kelo–Cote, A Revolutionary new form of gel sheeting without the sheet, Jul. 15, 1998.

Keloid Products, 1996.

*Primary Examiner*—Gloria M. Hale

(57) ABSTRACT

A perspiration shield takes the form of a multi-layered sheet that is shaped and sized to be placed between adjacent or opposing skin surfaces, such as under the breast, to prevent and absorb perspiration. The multi-layered sheet has an absorbent layer forming one surface of the shield and a silicone gel layer forming another surface of the shield. The silicone gel layer has a soft, tacky texture and readily adheres to the skin but leaves no perceptible residue on the skin when removed. The silicone gel layer closes the pores of the skin with which the layer is in contact, thereby reducing or preventing perspiration from these pores. The absorbent layer absorbs perspiration from the pores of the skin adjacent and opposing the skin surface to which the silicon gel layer is attached and is formed of a material that readily absorbs moisture. The absorbent layer and the silicone gel layer can be secured to each other via an intervening elastomeric layer, or the absorbent and silicone gel layers can be directly attached to each other. The perspiration shield can have a substantially flat, rectangular shape or an arcuate or contoured shape, and is sufficiently flexible to be bent or molded to a degree to substantially conform to the contours of the skin surface over which the shield is attached.

33 Claims, 3 Drawing Sheets

U.S. PATENT DOCUMENTS 5,269,720 A 12/1993 Moretz et al.
5,326,305 A 7/1994 Fochler
5,454,800 A * 10/1995 Hirt et al. ..... 604/378
5,603,653 A 2/1997 Hartman
5,664,984 A 9/1997 Laughridge
5,716,255 A 2/1998 Abercrombie et al.
5,790,982 A * 8/1998 Boutbout et al. ..... 2/53
5,972,487 A * 10/1999 Duenk et al. ..... 604/368
5,977,014 A * 11/1999 Plischke et al. ..... 604/368
6,145,129 A * 11/2000 Czekalla et al. ..... 2/53
6,203,399 B1 * 3/2001 Hackney ..... 450/1
6,241,713 B1 * 6/2001 Gross et al. ..... 604/368

* cited by examiner

PERSPIRATION SHIELD EMPLOYING GEL MATERIAL

CROSS-REFERENCE TO RELATED APPLICATIONS

This application claims priority from U.S. Provisional Patent Application Serial No. 60/148,272, entitled "Perspiration Shield Employing Gel Material" and filed Aug. 11, 1999. The disclosure of that provisional application is incorporated herein by reference in its entirety.

BACKGROUND OF THE INVENTION

1. Field of the Invention

The present invention relates to a perspiration shield which prevents and absorbs perspiration between skin surfaces in close proximity, such as beneath a woman's breasts or in the underarm region and, more particularly, to a perspiration shield having one side which directly adheres to the skin and prevents perspiration therefrom, and an opposite side which absorbs perspiration from the skin in contact therewith.

2. Description of the Related Art

The close proximity or direct contact of adjacent skin surfaces (e.g., along the underside of a woman's breasts or in the underarm area) can cause perspiration to develop, resulting in discomfort, skin irritation, odor or potentially embarrassing and damaging clothing stains. In recognition of this problem, various perspiration-absorbing devices have been proposed. One approach has been to permanently or removably attach a reusable or disposable absorbent pad to clothing worn adjacent the skin. For example, in U.S. Pat. No. 5,716,255 (incorporated herein by reference in its entirety), to address the problem of perspiration beneath women's breasts, there is disclosed a brassiere underliner which attaches to a lower portion of a brassiere via a tacky adhesive and absorbs the perspiration of the wearer. U.S. Pat. No. 5,664,984, incorporated herein by reference in its entirety, discloses a disposable moisture absorbent material shaped to fit the contour of a brassiere between the breast cups and attaches to the brassiere with a conventional adhesive. U.S. Pat. No. 5,103,500, incorporated herein by reference in its entirety, discloses a disposable underarm garment shield having a moisture absorbing layer which contacts the skin and is held in place by adhesive strips which secure the shield to the wearer's clothing.

One drawback of clothing-attached pads is that the position of the clothing may shift relative to the location of the skin, so that the pad is not in proper contact with the skin, thereby reducing the effectiveness of the pad. Further, since such pads may not be form-fitting, they may cause clothing to appear bulky or misshapen.

Another approach has been to use perspiration-absorbing pads which do not attach to a garment but, instead, are held in place by relying on the shape of the garment or by relying solely on pressure from the skin surfaces and frictional forces to hold the pad in place (e.g., by wedging the pad between adjacent skin surfaces). For example, U.S. Pat. No. 5,603,653, incorporated herein by reference in its entirety, discloses perspiration absorbent pads adapted for placement between the overlying breast and the adjacent skin surface of the torso to prevent skin-to-skin contact and to absorb perspiration. Either a brassiere or the adjacent skin surfaces themselves can be used to hold the pads in place. One disadvantage of unattached pads is that they have a tendency to slip or shift as the wearer moves.

While clothing items which attach directly to the skin via adhesive are known, such as the strapless brassiere disclosed in U.S. Pat. No. 3,934,593 (incorporated herein by reference in its entirety), for a variety of reasons, it has not been attempted to affix a perspiration prevention or absorption shield directly to the skin. Most adhesives which effectively adhere to the skin generally do not absorb moisture, lose their adhesive properties in the presence of moisture, and are often irritating to the skin. As a result, a shield attached directly to the skin with conventional adhesives would be ineffective in absorbing or preventing perspiration from the skin to which the shield is attached, and would have a tendency to detach from the skin in the presence of perspiration. Consequently, there remains a need for a shield that is effective in preventing or absorbing perspiration that does not require attachment to clothing and that does not tend to shift from its desired location.

OBJECTS AND SUMMARY OF THE INVENTION

It is an object of the present invention to prevent and absorb perspiration between adjacent skin surfaces which tend to exude perspiration.

It is a further object of the present invention to provide a perspiration shield which is held securely in place in close proximity to the skin without requiring attachment to the wearer's clothing.

Yet another object of the present invention is to directly adhere a perspiration shield to the wearer's skin without causing skin irritation or loss of adhesiveness or perspiration prevention.

The aforesaid objects are achieved individually and in combination, and it is not intended that the present invention be construed as requiring two or more of the objects to be combined unless expressly required by the claims attached hereto.

According to the present invention, a perspiration shield takes the form of a multi-layered sheet that is shaped and sized to be placed between adjacent or opposing skin surfaces, such as under the breast, to prevent and absorb perspiration. In accordance with one embodiment of the present invention, the perspiration shield is a substantially flat, rectangular strip or sheet having an absorbent layer forming one surface of the shield and a silicone gel layer forming another surface of the shield. The silicone gel layer has a soft, tacky texture and readily adheres to the skin but leaves no perceptible residue on the skin when removed. The silicone gel layer closes the pores of the skin with which the layer is in contact, thereby reducing or preventing perspiration from these pores. The absorbent layer absorbs perspiration from the pores of the skin adjacent and opposing the skin surface to which the silicon gel layer is attached and is formed of a material that readily absorbs moisture, such as those used for disposable diapers, panty liners or tampons.

The absorbent layer and the silicone gel layer can be secured to each other via an intervening elastomeric layer. The silicone gel readily adheres to one side of the elastomeric layer, while the absorbent layer is glued to the other side of the intervening elastomeric layer. In accordance with another embodiment, the absorbent layer and the silicone gel layer are directly secured to each other either by the inherent adhesiveness of the silicone gel layer to the surface of the absorbent layer or by glue. The silicone gel layer may be reinforced with another material such as a polyester meshwork backing or similar mesh material.

After peeling a protective film from the outer surface of the silicone gel layer, the perspiration shield is secured beneath the breast either by placing the silicon gel layer directly on the skin of the torso beneath the breast or by placing the silicon gel layer on the skin of the lower portion of the breast.

The perspiration shield of the present invention can be a substantially flat, rectangular strip or sheet, or the perspiration shield can be arcuate or contoured to fit the curves of the underside of the breast, with the perspiration shield being curved or tapered in one or more of its dimensions (i.e., length, width and thickness). The perspiration shield is sufficiently flexible to be bent or molded to a degree to substantially conform to the contours of the skin surface over which the shield is attached. In general, the multi-layer perspiration shield of the present invention can be shaped and sized to be placed in any folds or creases of skin where perspiration tends to develop between adjacent or opposing skin surfaces, such as in the underarm area.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DESCRIPTION OF THE PREFERRED EMBODIMENTS

Figure 1:
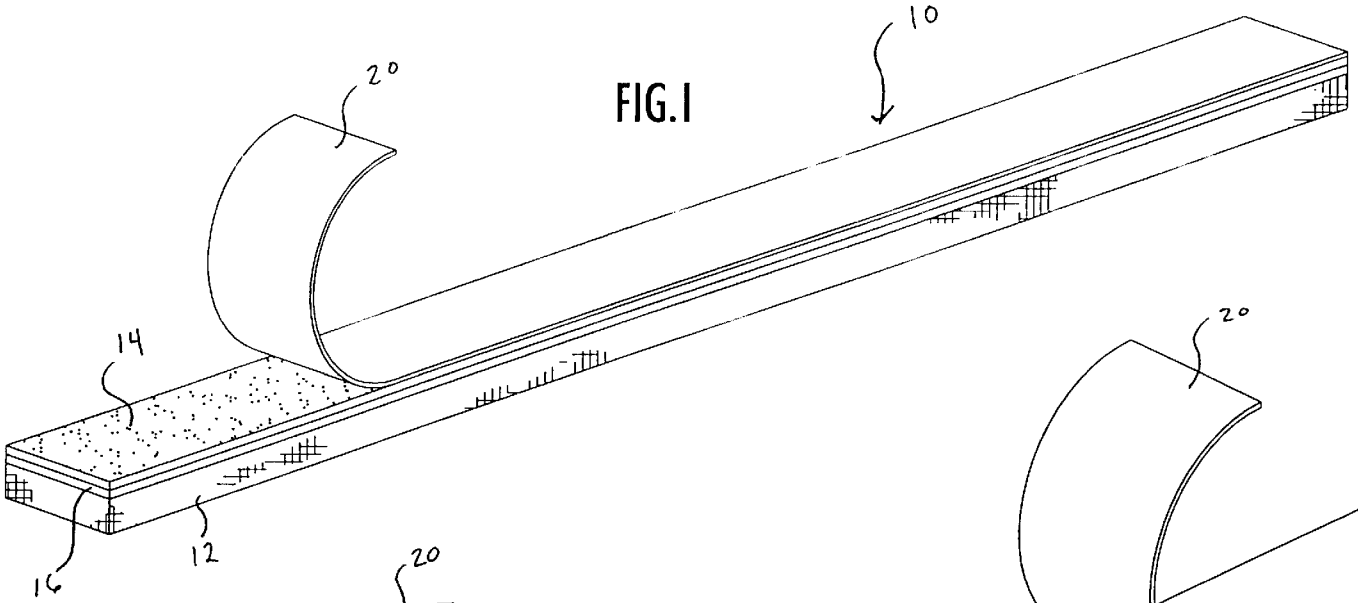
FIG. 1 is perspective view of a perspiration shield according to an exemplary embodiment of the present invention.

Referring to FIG. 1, a perspiration shield in accordance with an exemplary embodiment of the present invention takes the form of a substantially flat, rectangular, multi-layered strip or sheet 10 that is shaped and sized to be placed along and below the fold or crease between the underside of a woman's breast and the adjacent torso (i.e., under the breast) to prevent and absorb perspiration. For example, the overall dimensions of sheet 10 can be approximately five to six inches long, approximately one-half to one inch wide, and approximately one-quarter inch thick. It is to be understood that these dimensions are provided by way of example only and are not in any way limiting on the scope of the invention.

Figure 2:
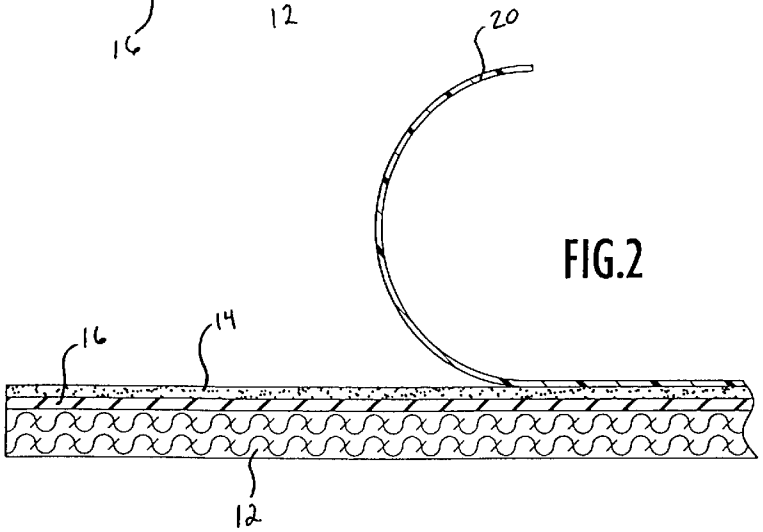
FIG. 2 is a side view in section of the perspiration shield shown in FIG. 1

As shown in greater detail in FIG. 2, an absorbent layer 12 forms one surface of sheet 10, and a silicone gel layer 14 forms another surface of sheet 10. Silicone gel layer 14 can be described as a soft, tacky, non-friable gel sheet that readily adheres to the skin and that leaves no perceptible residue (e.g., no sticky or gummy residue) on the skin when removed. Such silicone gels are manufactured, for example, by Applied Silicon Corporation and have been used in a number of medical applications, including treatment of burns and scars. By way of non-limiting example, silicon gel layer 14 can be approximately one-eighth to one-sixteenth of an inch thick. An important characteristic of silicon gel layer 14 is that the pores of the skin with which layer 14 is in contact are closed by the silicone gel; thus, these pores cannot readily exude perspiration. Consequently, the adhesiveness of silicon gel layer 14 cannot be significantly degraded by perspiration from the skin to which layer 14 is attached, and perspiration from these pores is advantageously reduced or prevented.

Absorbent layer 12 absorbs perspiration from the pores of the skin adjacent and in the vicinity of the skin surface to which silicon gel layer 14 is attached. Absorbent layer 12 is formed of a material that readily absorbs moisture. For example, absorbent layer 12 can have a moisture permeable outer covering formed of a natural or synthetic, woven or otherwise formed fabric material (e.g., cotton) which does not disintegrate when exposed to moisture, with a moisture absorbent fill also being a natural or synthetic loose fiber material or other material having suitable moisture absorbent properties (e.g., a moisture-absorbing powder or gel). The outer covering of absorbent layer 12 itself can be absorbent or can be non-absorbent and function to wick moisture away from the skin to the absorbent fill material. Preferably, absorbent layer 12 is formed of a super-absorbent material, such as those used for disposable diapers, panty liners or tampons. By way of non-limiting example, absorbent layer 12 can have a thickness of approximately one-quarter to one-eighth of an inch.

As shown in FIGS. 1 and 2, absorbent layer 12 and silicone gel layer 14 can be secured to each other via an intervening layer 16. Layer 16 can be, for example, an elastomeric material to which silicone gel layer 14 readily adheres. Silicon gel layer 14 is formed on one side of intervening elastomeric layer 16, while absorbent layer 12 is glued to the other side of intervening elastomeric layer 16. In addition to serving as a base layer to which absorbent layer 12 and silicone gel layer 14 can be readily attached, elastomeric layer 16 also provides additional overall strength to sheet 10 without significantly reducing the flexibility of sheet 10.

Figure 3:
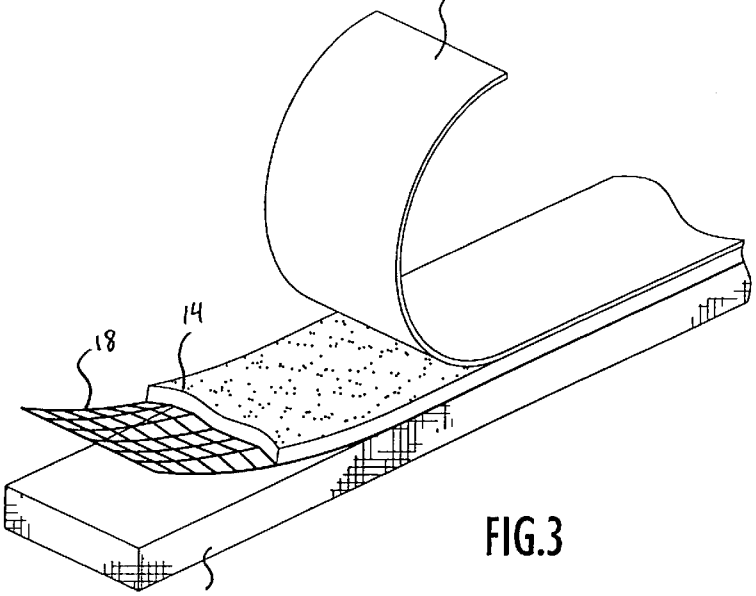
FIG. 3 is a perspective view of the layers of the perspiration shield in accordance with another embodiment of the present invention.

While shown in FIG. 1 with intervening layer 16, the perspiration shield of the present invention is not limited to a multi-layered sheet having such an intervening layer. Specifically, absorbent layer 12 and silicone gel layer 14 can be directly secured to each other either by the inherent adhesiveness of silicone gel layer 14 to the surface of absorbent layer 12 or by glue. In this arrangement, silicone gel layer 14 is preferably reinforced with another material such as the polyester meshwork backing 18 shown in FIG. 3 or other similar mesh material.

Figure 5:
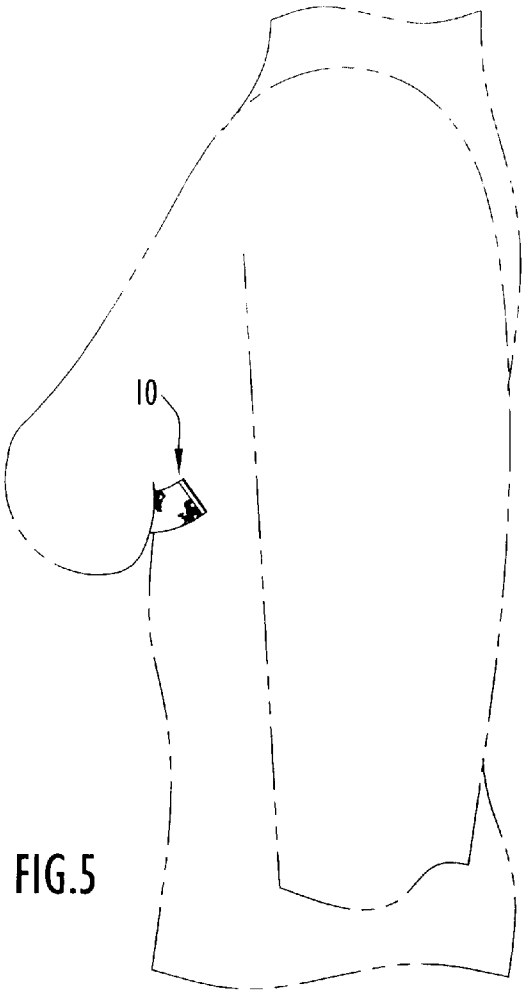
FIG. 5 is a side view in perspective of the perspiration shield of the present invention being worn beneath a woman's breast.
Figure 4:
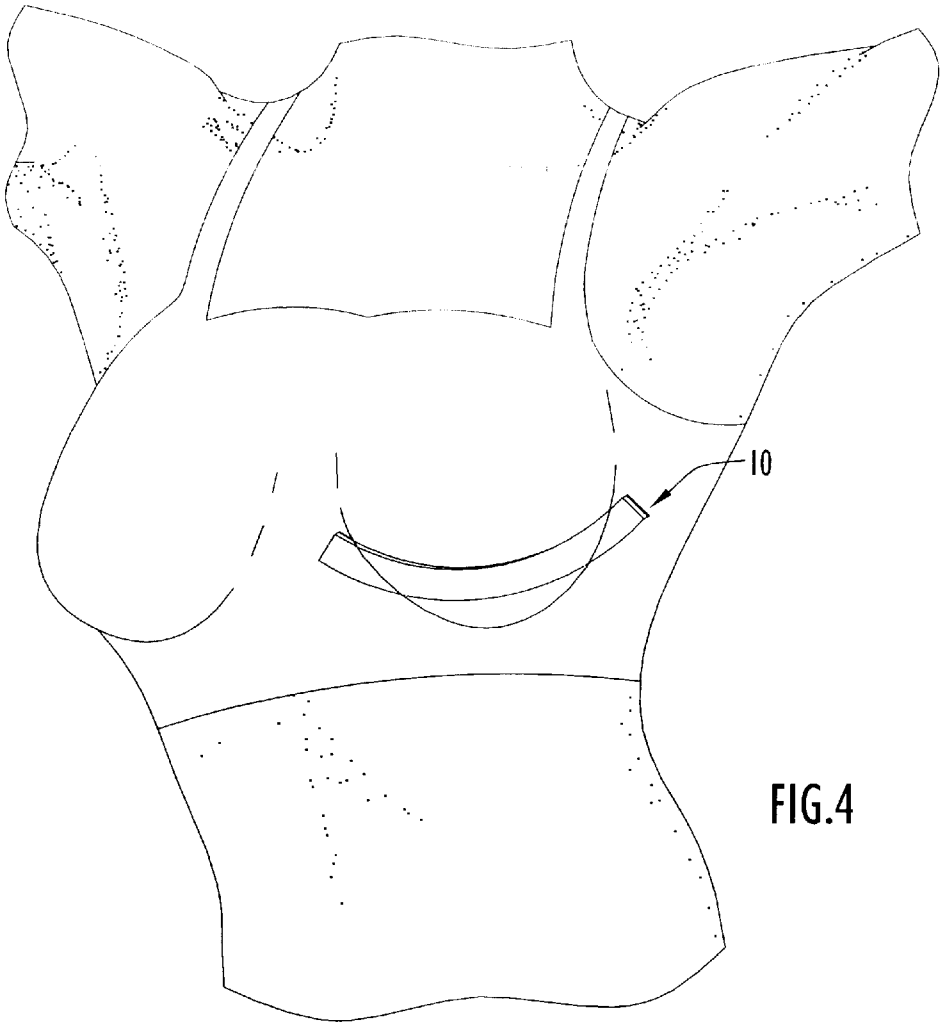
FIG. 4 is a perspective view of the perspiration shield of the present invention being worn beneath a woman's breast.

Prior to application to the skin, silicone gel layer 14 is covered with a protective thin, peelable layer 20 (FIGS. 1–3), such as a plastic film, to prevent silicone gel layer 14 from accidentally contacting other surfaces. In use, after removing protective layer 20, the perspiration shield is secured beneath the breast by placing silicon gel layer 14 directly on the skin of the torso beneath the breast with the absorbent layer 12 facing outward toward the overlying skin of the lower breast, as shown in FIG. 4 (front'view) and FIG. 5 (side view). Alternatively, silicon gel layer 14 can be placed directly on the skin along the lower base of the breast with absorbent layer 14 facing toward the torso.

Figure 6:
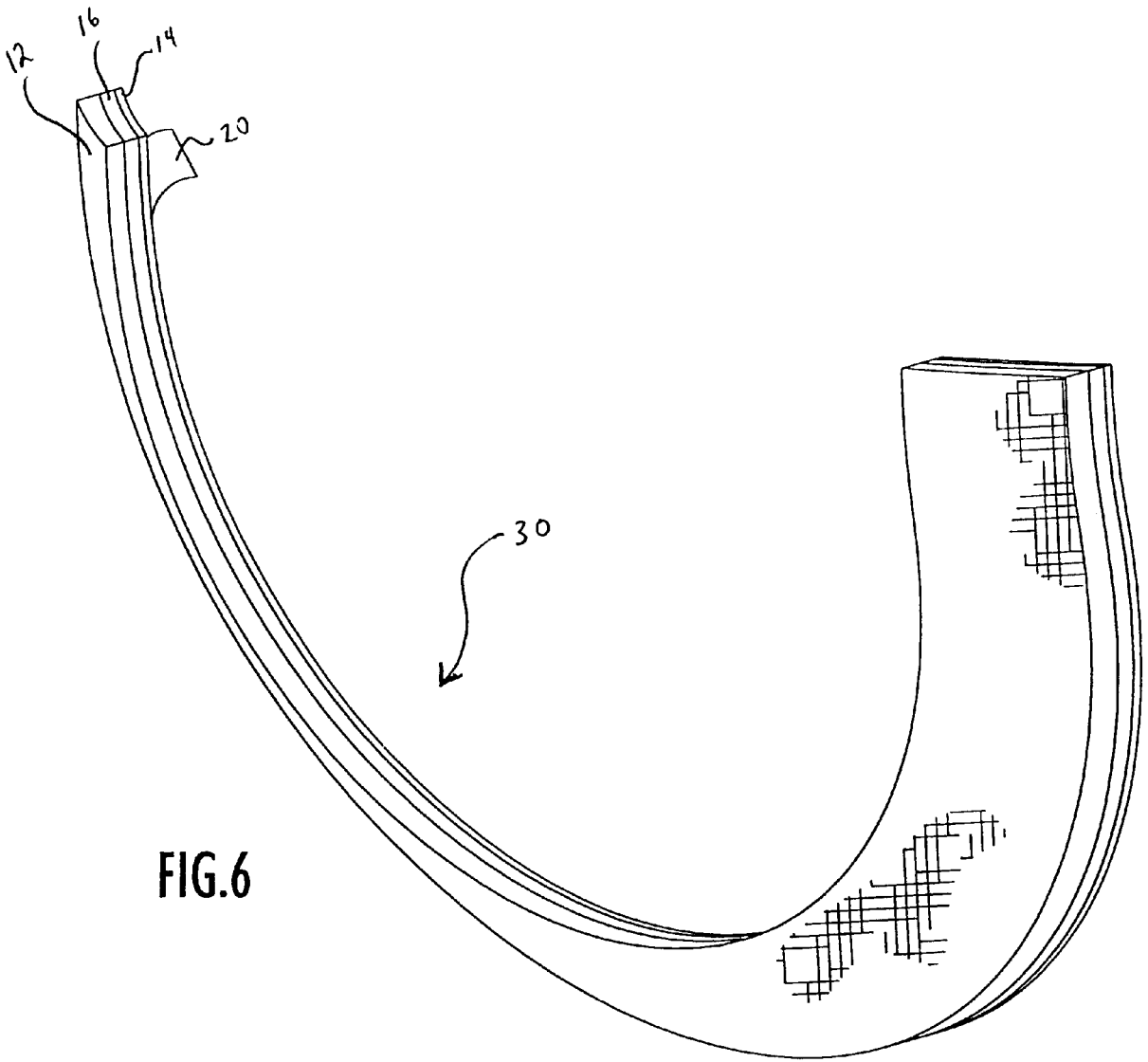
FIG. 6 is a perspective view of an arcuate perspiration shield in accordance with another embodiment of the present invention.

While shown in FIG. 1 as a substantially flat, rectangular sheet, the perspiration shield of the present invention need not be flat or rectangular. In accordance with the present invention, the perspiration shield can be arcuate or contoured to fit the curves of underside of the breast, with the perspiration shield being curved or tapered in one or more directions, i.e., along its length, width, and/or thickness. That is, the shape of the shield can be described as curving within a plane defined by orthogonal X and Y axes and/or curving with respect to the X-Y plane (i.e., in a Z direction orthogonal to the X-Y plane). For example, the perspiration shield can have a flat, planar crescent shape or C-shape (i.e., curved only in the X-Y plane), or a non-planar, arced crescent (i.e., curved in the X, Y and Z directions). A perspiration shield 30 substantially similar to shield 10 described above and having a curved configuration in accordance with the present invention is shown in FIG. 6. Whether formed as a rectangular strip, or curved or tapered along one or more dimensions, the perspiration shield of the present invention is flexible enough to be bent or molded to a degree to substantially conform to the contours of the skin surface over which the shield is attached. Optionally, the multi-layered shield can be formed as a larger sheet that can be cut into shapes of a desired size to form custom-shaped shields.

While the perspiration shield of the present invention has been shown and described in conjunction with use beneath the breast, it will be understood that the perspiration shield of the present invention in not limited to this embodiment. In general, the multi-layer perspiration shield of the present invention can be shaped and sized to be placed in any folds or creases of skin where perspiration tends to develop between adjacent skin surfaces, such as in the underarm area.

The perspiration shield of the present invention has several advantages over conventional perspiration shields. Specifically, the perspiration shield of the present invention does not require any attachment to clothing, thereby avoiding the problems of a bulky appearance and poor placement of the shield relative to the skin. Because the perspiration shield of the present invention is securely attached directly to the skin of the wearer, the shield does not slip or shift while being worn, and the flexibility of the shield allows the shield to bend in conformance with the movement of the wearer. The silicone gel layer does not irritate the skin, does not lose its adhesiveness, and actually prevents or reduces perspiration at the area of attachment. Perspiration exuded from the skin in the vicinity (e.g., adjacent or opposite) of the area of attachment is readily absorbed by the absorbent layer.

It will be appreciated that the embodiments described above and illustrated in the drawings represent only a few of the many ways of implementing a perspiration shield employing gel material.

The shields described above may be applied to any portions of a human or animal body for abortion of perspiration, bodily or other fluids. The shields may be of any size or shape to accommodate any portions of bodies, and may include any type of configuration (e.g., rectangular strip, curved or tapered in one or more directions, i.e., along its length, width, and/or thickness, flat planar crescent shape or C-shape (i.e., curved only in the X-Y plane), non-planar arced crescent (i.e., curved in the X, Y and Z directions), etc.). The shields can be formed for placement at any portion of the body (e.g., beneath breasts, underarm, forehead for use as a headband, etc.). The shields may be in the form of segments of any quantity, shape or size, and any quantity of the shield segments may be applied to the same or different body portions.

The absorbent layer of the shields may be of any shape or size and include any quantity of layers of any suitable materials (e.g., a material that readily absorbs moisture having a moisture permeable outer covering formed of a natural or synthetic, woven or otherwise formed fabric material (e.g., cotton) which does not disintegrate when exposed to moisture with a moisture absorbent fill also being a natural or synthetic loose fiber material or other material having suitable moisture absorbent properties (e.g., a moisture-absorbing powder or gel), a super-absorbent material (e.g., such as those used for disposable diapers, panty liners or tampons), etc.). The intervening layer of the shields may be of any shape or size and include any quantity of layers of any suitable materials (e.g., an elastomeric material or other material to which the gel layer may adhere, etc.). The protective layer of the shields may similarly be of any shape or size and include any quantity of layers of any suitable materials (e.g., plastic film, etc.). The backing may be of any shape or size and include any quantity of layers of any suitable materials (e.g., polyester meshwork, etc.). The absorbent, gel, intervening, backing and protective layers of the shields may be of any shape or size having any desired thickness.

The gel layer of the shields may be disposed on any portions or quantity of portions of the absorbent, intervening, backing and/or protective layers. The gel layer may be disposed on the shields via any conventional or other fastening techniques (e.g., by the inherent self-adhesiveness of the gel material, pressure (e.g., pressing the layers together), heat, suitable adhesive, glue, etc.). The gel layer of the shields may be secured to and detachable from any portion or portions of the absorbent, intervening, backing and protective layers. The gel layer may include any quantity of segments of any shape or size disposed at any suitable locations within the shields. The gel layer may include any anti-microbial or other agents (e.g., medicinal, ointments, lotions, etc.), and may be implemented by a silicone gel, hydrogel, polyurethane gel or other suitable materials. The gel layer may be porous to enable absorption of perspiration through the gel layer. The gel layer may be directly disposed on the absorbent layer without utilizing the intervening layer for the shields.

It is to be understood that the terms "left", "right", "front", "back", "rear", "top", "bottom", "upper", "lower", "horizontal", "vertical", "height", "length", "width", "thickness" and the like are used herein merely to describe points of reference and do not limit the present invention to any particular configuration or orientation.

Having described preferred embodiments of a new and improved perspiration prevention and absorption shield, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A perspiration shield that adheres directly to the skin of the wearer to absorb fluids from skin surfaces comprising:

a first layer including a gel adapted to adhere directly to a skin surface in contact with the gel; and a second layer including an absorbent material coupled to said first layer, wherein said second layer is adapted to absorb fluids from skin surfaces adjacent or opposing the skin surface to which said first layer is attached.

2. The shield according to claim 1, wherein said gel is a silicone gel that leaves no perceptible residue on the skin surface when removed.

3. The shield according to claim 1, further comprising an intervening layer formed between said first layer and said second layer.

4. The shield according to claim 3, wherein said intervening layer is elastomeric, said first layer being attached to a first side of said intervening layer, and said second layer being attached to a second side of said intervening layer.

5. The shield according to claim 1, wherein said first layer is in contact with said second layer.

6. The shield according to claim 1, wherein said first layer is glued to said second layer.

7. The shield according to claim 1, wherein said first layer is reinforced with a mesh material.

8. The shield according to claim 1, wherein said second layer comprises a moisture permeable outer covering comprising a fabric material and a moisture absorbent inner fill material.

9. The shield according to claim 1, further comprising a peelable protective layer formed on said first layer.

10. The shield according to claim 1, wherein said shield is substantially flat, and surfaces of said first and second layers are substantially planar.

11. The shield according to claim 10, wherein said shield has a substantially rectangular shape.

12. The shield according to claim 10, wherein said shield is curved along a plane.

13. The shield according to claim 1, wherein said shield has an arcuate shape and is curved in at least one of a length direction, a width direction and a thickness direction.

14. The shield according to claim 1, wherein said shield is sufficiently flexible to be molded to contours of the skin surface to which said first layer is attached.

15. The shield according to claim 1, wherein said shield has a shape and size adapted for placement beneath the underside of a breast.

16. The shield according to claim 1, wherein said shield has a shape and size adapted for placement in the wearer's underarm area.

17. A method of forming a perspiration shield that adheres directly to the skin of the wearer to absorb fluids from skin surfaces comprising the steps of:

(a) forming a gel layer adapted to directly adhere to a skin surface;

(b) forming an absorbent layer; and (c) coupling the gel layer to the absorbent layer such that the absorbent layer is configured to absorb fluids from skin surfaces adjacent or opposing the skin surface to which the gel layer is attached.

18. The method according to claim 17, wherein the gel layer is formed of a silicone gel that leaves no perceptible residue on the skin surface when removed.

19. The method according to claim 17, wherein the gel layer is attached to the absorbent layer.

20. The method according to claim 17, further comprising the step of:

(d) forming an intervening layer between the gel layer and the absorbent layer, such that the gel layer is attached to a first side of the intervening layer, and the absorbent layer is attached to a second side of the intervening layer.

21. A method of absorbing fluids from skin surfaces comprising the steps of:

(a) placing a gel layer of a perspiration shield on a skin surface, the gel layer adhering to the skin surface; and (b) absorbing fluids from a skin surface adjacent or opposing the skin surface to which the gel layer is attached, with an absorbent layer of the shield, which absorbent layer is coupled to the gel layer.

22. The method according to claim 21, wherein the gel layer placed on the skin surface is a silicone gel that leaves no perceptible residue on the skin surface when removed.

23. The method according to claim 21, wherein perspiration is absorbed by the absorbent layer comprising a moisture permeable outer covering and a moisture absorbent inner fill material.

24. The method according to claim 21, wherein said step (a) further includes placing the shield beneath the underside of a breast.

25. The method according to claim 24, wherein the gel layer is attached to a skin surface of the torso.

26. The method according to claim 24, wherein the gel layer is attached to the underside of a breast.

27. The method according to claim 21, wherein step (a) further includes placing the shield in an underarm area.

28. The shield according to claim 1, wherein said gel is adapted to adhere directly to and close pores of said skin surface in contact with the gel, thereby substantially reducing fluids from pores of the skin surface.

29. The method of claim 17, wherein step (a) further includes:

(a.1) forming said gel layer adapted to directly adhere to and close pores of said skin surface.

30. The method of claim 21, wherein step (a) further includes:

(a.1) placing said gel layer on said skin surface with the gel layer adhering to and closing pores of the skin surface, thereby substantially reducing fluids from pores of the skin surface.

31. The shield according to claim 1, wherein said second layer absorbs perspiration from said adjacent or opposing skin surfaces.

32. The method of claim 17, wherein step (c) further includes:

(c.1) coupling the gel layer to the absorbent layer such that the absorbent layer is configured to absorb perspiration from said adjacent or opposing skin surfaces.

33. The method of claim 21, wherein step (b) further includes:

(b.1) absorbing perspiration from said adjacent or opposing skin surface.

* * * * *